US008591355B2

(12) United States Patent
Sullivan et al.

(10) Patent No.: US 8,591,355 B2
(45) Date of Patent: Nov. 26, 2013

(54) GOLF BALL WITH DIMPLES HAVING CONSTANT DEPTH

(75) Inventors: Michael J. Sullivan, Barrington, RI (US); William E. Morgan, Barrington, RI (US); Herbert C. Boehm, Norwell, MA (US)

(73) Assignee: Acushnet Company, Fairhaven, MA (US)

( * ) Notice: Subject to any disclaimer, the term of this patent is extended or adjusted under 35 U.S.C. 154(b) by 503 days.

(21) Appl. No.: 12/987,625

(22) Filed: Jan. 10, 2011

(65) Prior Publication Data

US 2011/0111887 A1 May 12, 2011

Related U.S. Application Data

(60) Continuation of application No. 12/061,779, filed on Apr. 3, 2008, now Pat. No. 7,867,109, which is a continuation-in-part of application No. 11/141,093, filed on May 31, 2005, now Pat. No. 7,455,601, which is a division of application No. 10/077,090, filed on Feb. 15, 2002, now Pat. No. 6,905,426.

(51) Int. Cl.
*A63B 37/12* (2006.01)

(52) U.S. Cl.
USPC ..... 473/383

(58) Field of Classification Search
USPC ..... 473/383, 384
See application file for complete search history.

(56) References Cited

U.S. PATENT DOCUMENTS

| | | | | |
|---|---|---|---|---|
| 55,330 A | | 6/1866 | Robertson | |
| 1,418,220 A | | 5/1922 | White | |
| 1,656,408 A | | 1/1928 | Young | |
| 1,681,167 A | | 8/1928 | Beldam | |
| 4,090,716 A | | 5/1978 | Martin | |
| 4,787,638 A | | 11/1988 | Kobayashi | |
| 4,830,378 A | | 5/1989 | Aoyama | |
| 5,005,838 A | | 4/1991 | Oka | |
| 5,114,099 A | | 5/1992 | Gao | |
| 5,174,578 A | | 12/1992 | Oka et al. | |
| 5,338,039 A | | 8/1994 | Oka et al. | |
| 5,377,989 A | * | 1/1995 | Machin | 473/379 |
| 5,470,076 A | | 11/1995 | Cadorniga | |
| 5,503,398 A | | 4/1996 | Lu | |
| 5,536,013 A | | 7/1996 | Pocklington | |
| 5,566,943 A | | 10/1996 | Boehm | |
| 5,842,937 A | | 12/1998 | Dalton et al. | |
| 6,010,442 A | | 1/2000 | Lemons et al. | |
| 6,059,671 A | | 5/2000 | Asakura | |

(Continued)

FOREIGN PATENT DOCUMENTS

| | | |
|---|---|---|
| GB | 2103939 | 3/1983 |
| WO | 00/48687 | 8/2000 |

*Primary Examiner* — Raeann Gorden

(74) *Attorney, Agent, or Firm* — Daniel W. Sullivan

(57) ABSTRACT

A golf ball having an improved dimple pattern is disclosed. The dimples may have a regular or irregular polygonal perimeter, an undimpled land surface and a depression therein. The perimeter may alternatively comprise a number of linear sides and at least one curved side. At least a portion of the bottom of the depression is convex such that its curvature is substantially identical to the curvature of the land surface making the depth of that portion constant along its surface relative to the land surface. The depression may further comprise a sub-depression. Alternatively, the depression may further comprise a projection. Additionally, the depression may have a polygonal or circular perimeter.

11 Claims, 10 Drawing Sheets

(56) References Cited

U.S. PATENT DOCUMENTS

| | | | | |
|---|---|---|---|---|
| 6,066,055 | A | 5/2000 | Nishino | |
| 6,162,136 | A | 12/2000 | Aoyama | |
| 6,176,793 | B1 | 1/2001 | Sullivan et al. | |
| 6,290,615 | B1 | 9/2001 | Ogg | |
| 6,315,686 | B1 | 11/2001 | Barfield | |
| 6,695,720 | B2 | 2/2004 | Sullivan | |
| 6,884,183 | B2 | 4/2005 | Sullivan | |
| 7,018,308 | B2 * | 3/2006 | Kasashima | 473/383 |
| 7,867,109 | B2 * | 1/2011 | Sullivan et al. | 473/383 |

* cited by examiner

GOLF BALL WITH DIMPLES HAVING CONSTANT DEPTH

CROSS REFERENCE TO RELATED APPLICATIONS

This application is continuation of U.S. patent application Ser. No. 12/061,779, filed on Apr. 3, 2008, now U.S. Pat. No. 7,867,109 which is a continuation-in-part of U.S. patent application Ser. No. 11/141,093, filed on May 31, 2005, now U.S. Pat. No. 7,455,601 which is a division of U.S. patent application Ser. No. 10/077,090, filed on Feb. 15, 2002 and patented under U.S. Pat. No. 6,905,426 on Jun. 14, 2005, the disclosures of each being incorporated by reference herein in their entireties.

FIELD OF THE INVENTION

The present invention relates to golf balls, and more particularly, to golf balls having improved dimple patterns.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities, thus different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the boundary layer stays attached further along the ball's outer surface. As a result, there is a reduction in the area of the wake, an increase in the pressure behind the ball, and a substantial reduction in drag. It is the circumference of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is important in optimizing this flow phenomenon, as well.

By using dimples to decrease drag and increase lift, almost every golf ball manufacturer has increased their golf ball flight distances. In order to improve ball performance, it is desirable to have a large number of dimples, hence a large amount of dimple circumference, which is evenly distributed around the ball. In arranging the dimples, an attempt is made to minimize the space between dimples, because such space does not improve aerodynamic performance of the ball. In practical terms, this usually translates into 300 to 500 circular dimples with a conventional sized dimple having a diameter that typically ranges from about 0.100 inches to about 0.180 inches.

When compared to one conventional size dimple, theoretically, an increased number of small dimples will create greater aerodynamic performance by increasing total dimple circumference. However, in reality small dimples are not always very effective in decreasing drag and increasing lift. This results at least in part from the susceptibility of small dimples to paint flooding. Paint flooding occurs when the paint coat on the golf ball fills the small dimples, and consequently decreases the dimple's aerodynamic effectiveness. On the other hand, a smaller number of large dimples also begin to lose effectiveness. This results from the circumference of one large dimple being less than that of a group of smaller dimples.

Another attempt to improve dimple coverage is to use polygonal dimples with the polyhedron dimple surfaces, i.e., dimple surfaces constructed from one or more planar surfaces, as suggested in a number of patent references including U.S. Pat. Nos. 6,290,615, 5,338,039, 5,174,578, 4,830,378, and 4,090,716 among others. Theoretically, higher dimple coverage is attainable with these polygonal dimples. As shown in FIGS. 1 and 2, the land area between the polygonal dimples typically has uniform width throughout the surface of the ball. As the width of the land area decreases, the dimple coverage increases. However, these references do not fully utilize the inner geometry of the dimples.

Hence, there remains a need in the art for a golf ball that exhibits improved aerodynamic performance and improved utilization of dimple geometry.

SUMMARY OF THE INVENTION

The present invention is directed to a golf ball with improved dimple patterns.

Accordingly, the present invention teaches a golf ball comprising a substantially spherical outer surface and a plurality of dimples formed thereon. The dimples of the present invention may comprise a polygonal perimeter and a polygonal depression. Alternatively, the dimples may comprise a polygonal perimeter having a spherical depression. The dimples may additionally have a perimeter comprising a number of linear sides and at least one curved side. At least a portion of the bottom of the depression is convex such that it has a curvature substantially identical to the curvature of the undimpled land surface of the golf ball, and therefore has a depth along its surface that is substantially constant relative to the land surface. The convex nature of the bottom surface of the dimples forces the dimples upward, thereby enhancing the dimples' influence on the airflow around the ball. This influence can add to the dimples' ability to enhance the turbulent layer to increase lift and reduce drag.

The dimples of the present invention may additionally comprise a sub-depression within the dimples. In this embodiment, the sub-depression may have a convex surface having a curvature substantially identical to the curvature of the land surface such that its depth is constant in relation to the land surface. Alternatively, the dimples of the present invention may comprise a projection or convex sub-dimple therewithin. The projection may have a convex surface having a curvature substantially identical to the curvature of the land surface such that its depth is constant in relation to the land surface.

The golf ball of the present invention may further comprise first inter-dimple spacings having a constant width and second inter-sectional spacings having a constant width. Said inter-sectional spacings separate discernable groups of dimples. The width of first inter-dimple spacings is different than the width of second inter-sectional spacings.

The perimeter of the dimples of the present invention may have an irregular polygonal shape. According to this embodiment, the shape of a dimple does not dictate the shape of neighboring dimples. Alternatively, the dimples of the present invention may have an isodiametrical shape wherein the perimeter comprises an odd number of sides having arcuate vertices.

DETAILED DESCRIPTION

Figure 1:
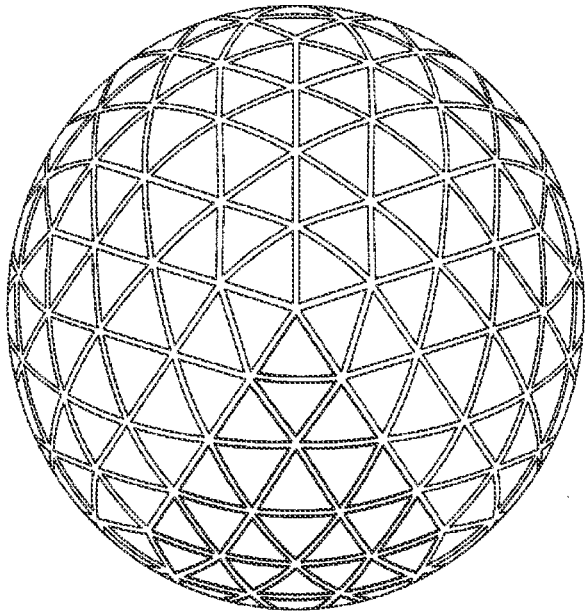
(PRIOR ART) FIG. 1
FIGS. 1 and 2 show a golf ball having a dimple pattern known in the prior art.
Figure 2:
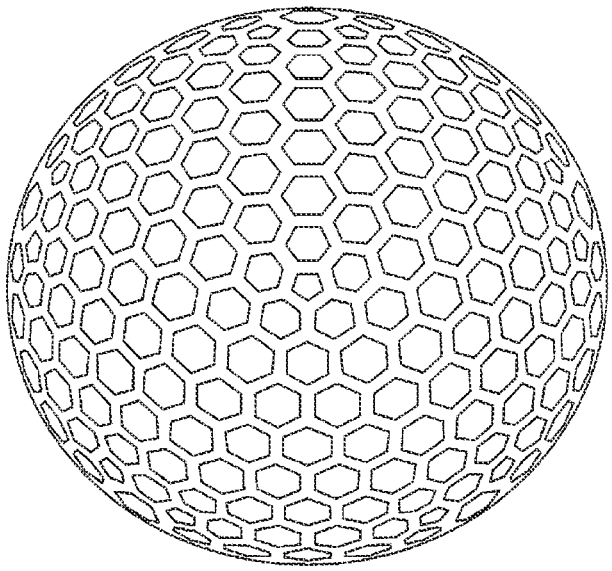
(PRIOR ART) FIG. 2

The present invention is directed to a golf ball having a plurality of dimples on its surface separated by outer undimpled land surfaces. Preferably, the inventive dimples have non-circular perimeters such as regular and irregular polygons. Like the known golf balls shown in FIGS. 1 and 2, the dimples of the present invention preferably comprise a regular or substantially regular polygonal perimeter such that the boundaries of each polygonal dimple are parallel with the boundaries of their neighboring dimples. Accordingly, the dimples may be triangular, rectangular, pentagonal, hexagonal, or any other suitable polygonal shape. Additionally, the dimples of the present invention preferably comprise a constant depth area relative to the land area. The entire bottom of the dimple may have a constant depth. In accordance with the invention, a significant portion of the bottom of the dimple may have a constant depth. Preferably, at least 50 percent of the surface area of the dimple comprises a surface having constant depth relative to the land area. More preferably, at least 67 percent of the surface area of the dimple comprises a surface having constant depth relative to the land area. Most preferably, at least 80 percent of the surface area of the dimple comprises a surface having a constant depth relative to the land area.

Figure 3:
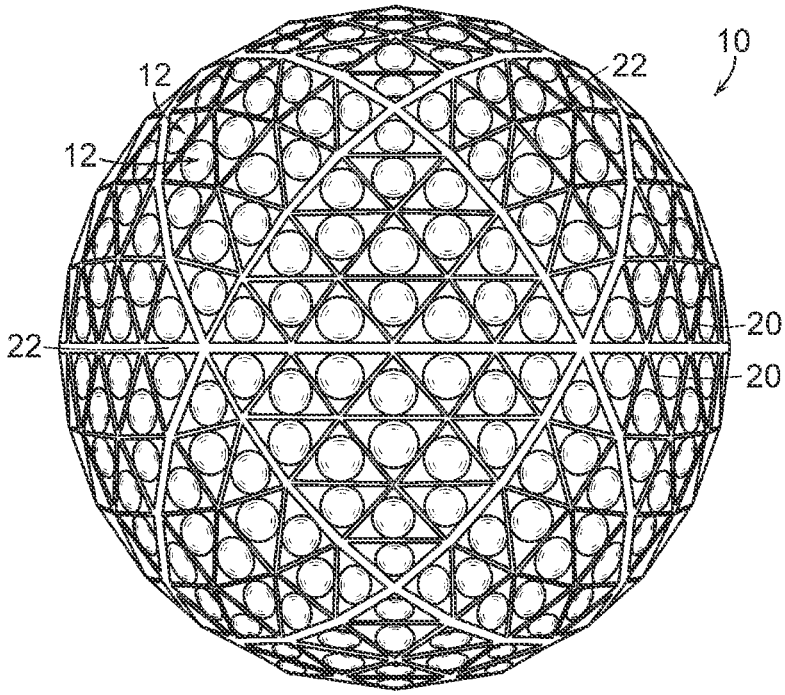
FIG. 3 shows a golf ball having an icosahedron pattern of spherical polygonal dimples.
Figure 4:
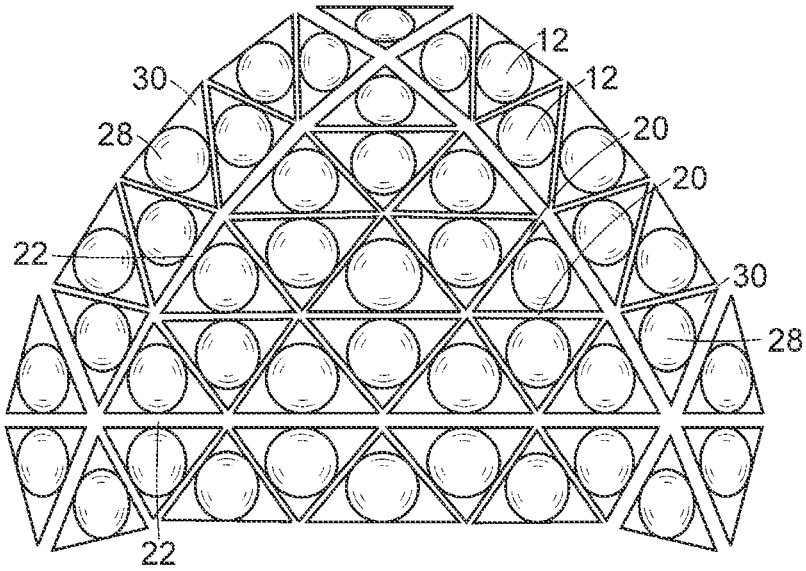
FIG. 4 is an enlarged view of a section of the surface of the golf ball of FIG. 3.
Figure 5:
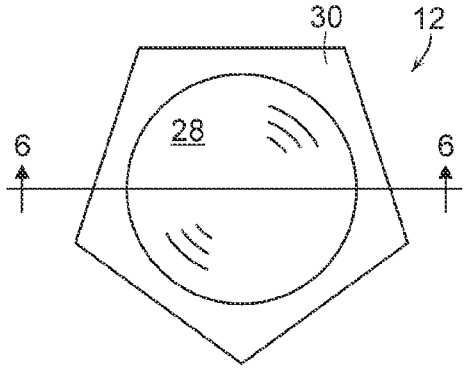
FIG. 5 shows an exemplary dimple having constant depth over a portion thereof.
Figure 6:
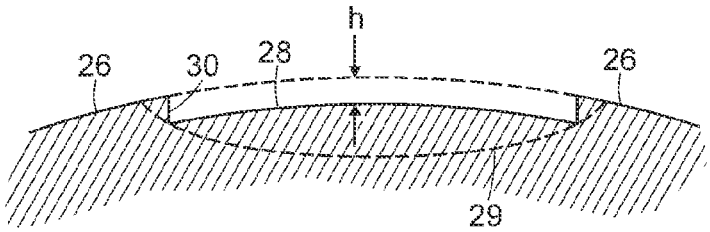
FIG. 6 is a cross-sectional view of an inventive dimple.

According to one embodiment of the present invention, golf ball 10, shown in FIG. 3, comprises a number of polygonal dimples 12 on its surface. The polygonal dimples 12 have spherical depressions, and hence can be called spherical polygonal dimples. Spherical polygonal dimples are discussed in commonly owned U.S. Pat. No. 6,905,426, incorporated herein by reference in its entirety. FIG. 4 shows an enlarged view of a portion of FIG. 3, wherein the spherical polygonal dimples 12 are more clearly shown to be separated by land surfaces having either a first width 20 or a second width 22. The perimeter of spherical polygonal dimples 12 may have any polygonal shape, such as triangular, pentagonal, hexagonal, octagonal, etc. In accordance with this embodiment and shown in FIGS. 4, 5 and 6, dimple 12 comprises a polygonal perimeter having a spherical depression, said depression comprising bottom 28 and transition area 30. Transition area 30 is situated at about a 90 degree angle, preferably a 60 to 80 degree angle, to bottom 28 to maximize the surface area of bottom 28 relative to the area defined by the perimeter of dimple 12. Additionally, bottom 28 has a convex surface having substantially the same curvature as the surface of land 26 such that depth h is substantially constant relative to land 26. Preferably, bottom 28 comprises at least 50 percent of the area of dimple 12. More preferably, bottom 28 comprises at least 67 percent of the area of dimple 12. Most preferably, bottom 28 comprises at least 80 percent of the area of dimple 12. As best shown in FIG. 6, the profile of dimple 12 shows bottom 28 juxtaposed upward compared to the profile of a spherical concave bottom 29 of conventional dimples, shown in phantom. This juxtaposition upward increases the dimples' influence on the airflow above it to energize or agitate the airflow over the dimpled surfaces to increase the aerodynamic performance of the golf ball.

Figure 7:
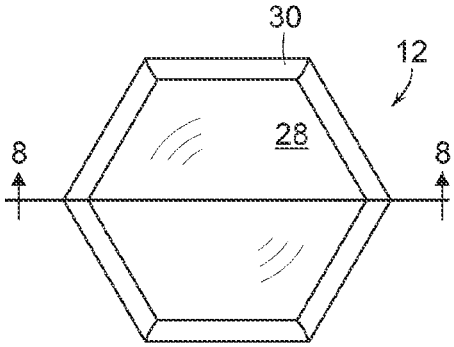
FIG. 7 shows another dimple according to an aspect of the present invention.
Figure 8:
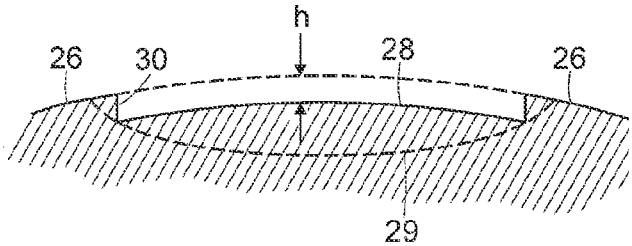
FIG. 8 is a cross-sectional view of the dimple of FIG. 7.

As shown in FIGS. 7 and 8, dimple 12 may also comprise a polygonal perimeter and a polygonal depression or a polygonal-polygonal dimple. As in FIG. 6, the polygonal depression of FIG. 8 comprises bottom 28 and transition area 30. Transition area 30 is preferably situated at about 90 degree angle to bottom 28 so that bottom 28 has a surface area substantially equal to the area defined by the perimeter. Again, bottom 28 preferably has a convex shape having a curvature about equal to the curvature of land 26 such that depth h is constant relative to land 26. Similar to the spherical polygonal dimple shown in FIG. 6, bottom 28 of the polygonal-polygonal dimple also juxtaposes above the profile of a conventional spherical concave bottom 29.

Figure 9:
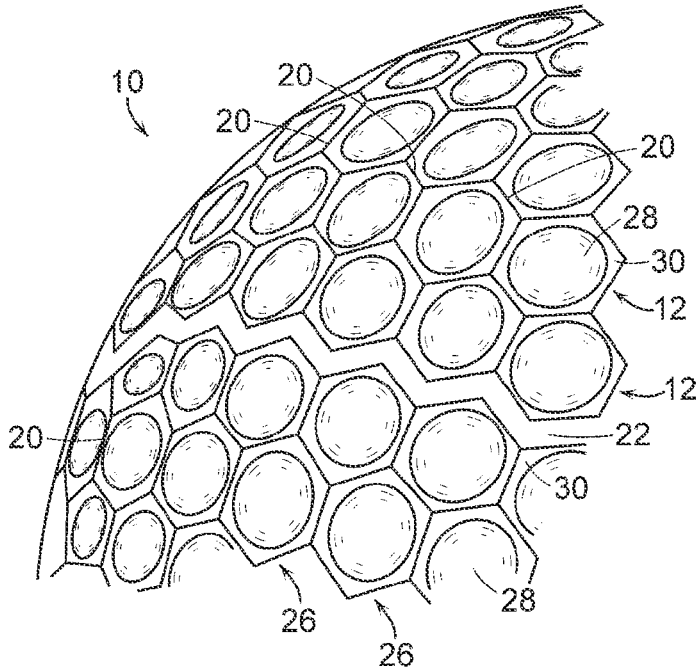
FIGS. 9 and 10 show portions of the surface of a golf ball according to an embodiment of the present invention.
Figure 10:
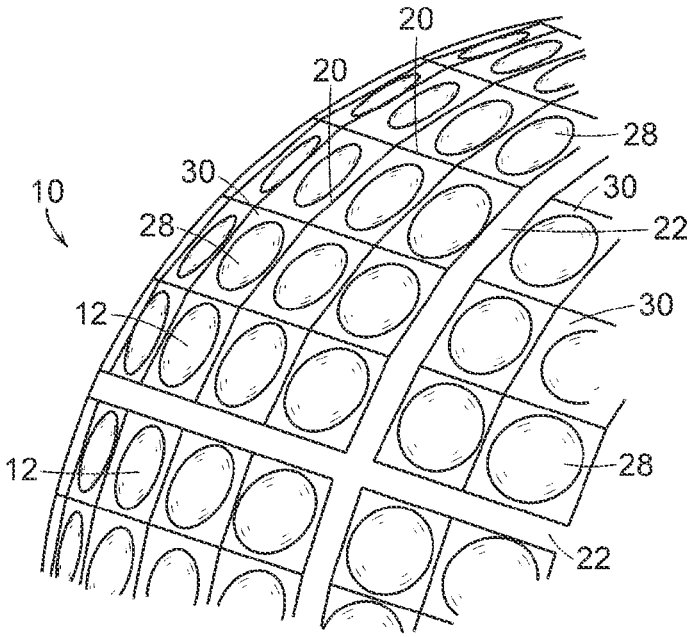

Inventive dimples 12 can be arranged in any known pattern on the golf ball. Referring to FIGS. 3, 4, 9 and 10, golf ball 10 of the present invention may comprise a plurality of inventive dimples 12 on its surface, said dimples separated by land areas having a first width 20 or a second width 22. First width 20 refers to inter-dimple spaces separating dimples 12 in a particular identifiable section of dimples. Second width 22 refers to the spaces separating dimples 12 of one identifiable section from dimples 12 of another identifiable section. Said inter-dimple and inter-sectional spacings are discussed in commonly owned U.S. Pat. No. 6,884,183, incorporated herein by reference in its entirety. Widths 20 and 22 can also have the same width. The dimple arrangement of FIG. 3 follows an icosahedron pattern wherein the surface of golf ball 10 is covered by twenty triangular sections of dimples 12. In accordance with one embodiment of the present invention, the inter-dimple spaces separating dimples in a section have a first width 20 that is constant; likewise, inter-sectional spaces have a second width 22 that is constant. The second width 22 of inter-sectional spaces is preferably greater than the first width 20 of inter-dimple spaces. Golf ball 10 may have other arrangements of dimple sections, such patterns including tetrahedron, octahedron, hexahedron, dodecahedron, and other patterns including irregularly shaped sections. Inter-sectional spaces having second width 22 may form great circles around the ball, including an equator as seen in FIG. 9.

In another embodiment of the present invention, width 20, defined by the inter-dimple spacings between dimples of one identifiable section, may vary between sections. In yet another embodiment of the present invention, width 20 may vary within dimple sections. Similarly, width 22, defined by the spacings between sections of dimples, may vary over the surface of golf ball 10.

Figure 11:
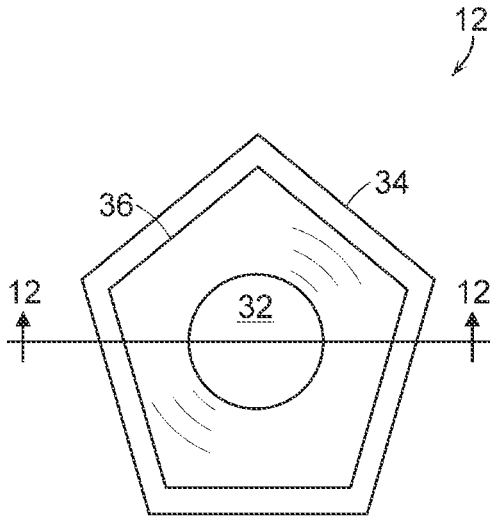
FIG. 11 shows another dimple according to an embodiment of the present invention.
Figure 12:
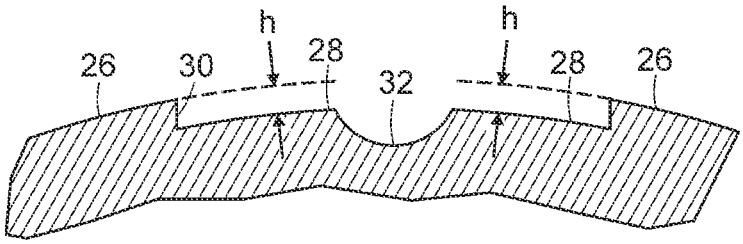
FIG. 12 is a cross-sectional view of the dimple of FIG. 11.
Figure 22:
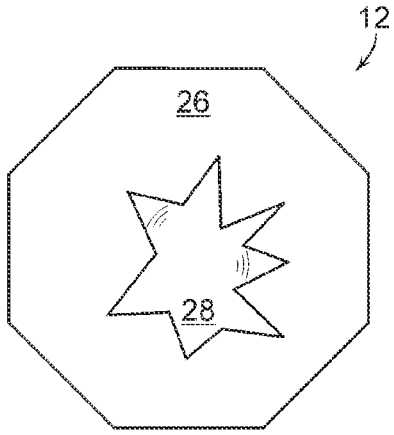
Figure 23:
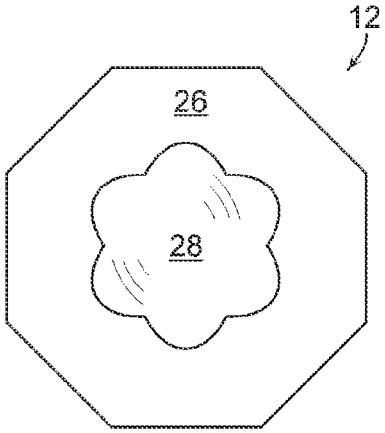
Figure 24:
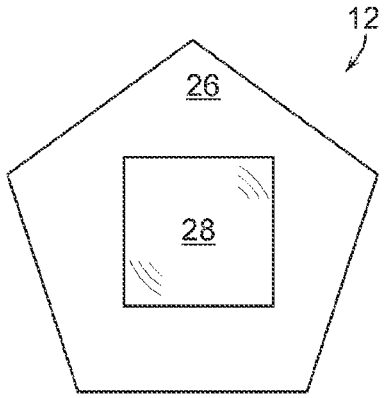

FIGS. 11 and 12 illustrate another embodiment of the present invention wherein dimple 12 comprises transition area 30, bottom 28 and subdimple 32. According to this embodiment, dimple 12 has a polygonal perimeter 34 and an inner polygonal depression 36. The inner polygonal depression 36 including a spherical sub-depression called subdimple 32. Transition area 30 meets bottom 28 at a substantially 90 degree angle, more preferably between 60 and 80 degrees. The surface of bottom 28 curves such that it has substantially the same shape as land 26. The depth h of bottom 28 is therefore constant in relation to land 26. The surface of subdimple 32 is concave and does not have a constant depth relative to land 26. While perimeter 34 and depression 36 are shown to have similar shape, they can have different shape, e.g., perimeter 34 can be a pentagon and depression 36 can be a square, as depicted in FIG. 24, or perimeter 34 can be a regular polygon and depression 36 can be an irregular polygon, as shown in FIG. 22.

Figure 13:
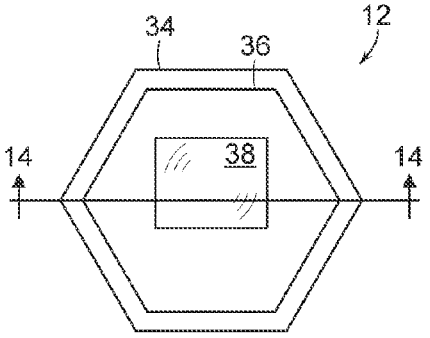
FIG. 13 shows another dimple according to an embodiment of the present invention.
Figure 14:
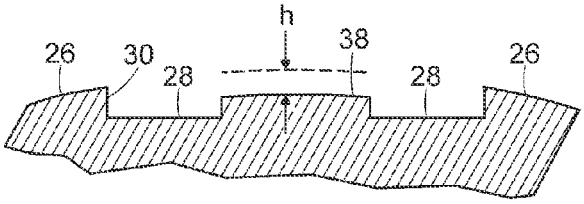
FIG. 14 is a cross-sectional view of the dimple of FIG. 13.

Dimple 12 may also have varying depth as described in FIGS. 13 and 14. According to this aspect of the invention, dimple 12 comprises a polygonal perimeter 34 and a polygonal depression 36. Polygonal depression 36 comprises transition area 30, bottom 28 and projection 38. As in above embodiments, transition area 30 is located at a substantially 90 degree angle with bottom 28. Bottom 28 is substantially flat creating a depth relative to land 26 that varies along its surface. Alternatively, bottom 28 can have an angled, concave or curved surface that creates a varied depth relative to land 26. Projection 38 of polygonal depression 36 has a convex surface having a curvature substantially identical to the curvature of land 26 such that the depth h is constant relative to land 26. Projection 38 may be circular, polygonal or any other suitable shape. As in commonly-owned U.S. patent application Ser. No. 10/338,379 and commonly-owned U.S. Pat. No. 6,569,038, previously incorporated by reference herein in their entireties, the convex projection 38, or convex subdimple, may protrude from 0.0001-0.010 inches from bottom 28. Additionally, the surface of golf ball 10 may comprise a number of dimples all having convex sub-dimples, or a number of dimples all having concave sub-dimples, or a mixture of dimples having convex or concave sub-dimples.

Figure 15:
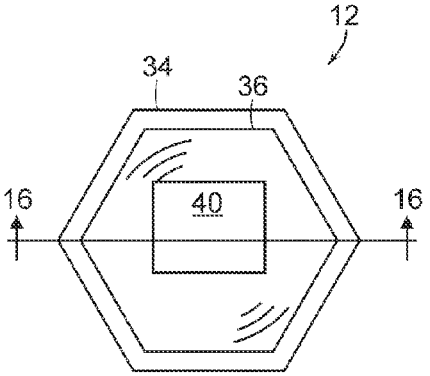
FIG. 15 shows another dimple according to an embodiment of the present invention.
Figure 16:
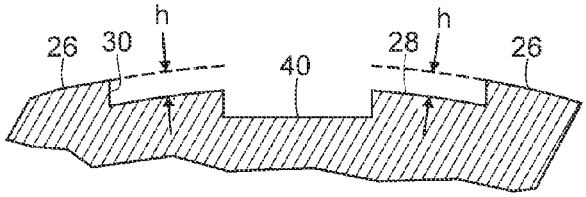
FIG. 16 is a cross-sectional view of the dimple of FIG. 15.

In a variation of the above embodiment, FIGS. 15 and 16 show dimple 12 comprising a polygonal perimeter 34 and inner polygonal depression 36. Polygonal depression 36 includes transition area 30, bottom 28, and subdimple 40. Similar to a previous embodiment, subdimple 40 comprises a subdepression within polygonal depression 36. According to this embodiment, transition area 30 meets bottom 28 at a substantially 90 degree angle, more preferably between 60 and 80 degrees. Bottom 28 has a convex surface having a curvature substantially identical to the curvature of land 26 such that the depth h is constant relative to land 26. Subdimple 40 has a substantially flat bottom such that its depth varies along its surface relative to land 26. The surface of subdimple 40 may also be angled, curved or concave so as to create a varied depth relative to land 26. Subdimple 40 may be polygonal, circular or any other suitable shape.

Figure 17:
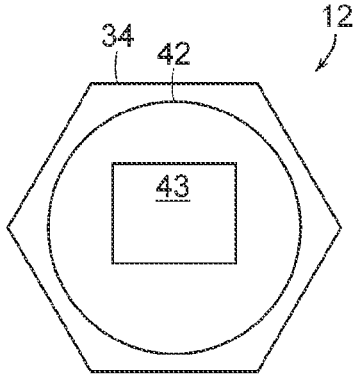
FIG. 17 shows another dimple according to an embodiment of the present invention.
Figure 18:
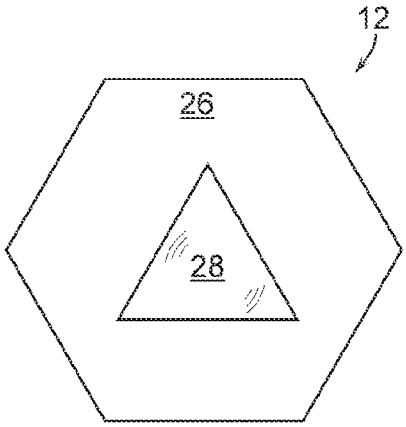
FIGS. 18-25 show inventive dimples having a variety of perimeter and depression shapes.
Figure 19:
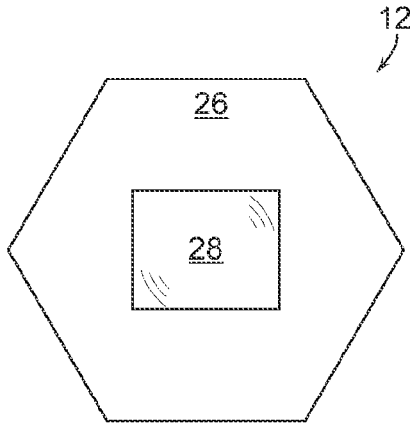
Figure 20:
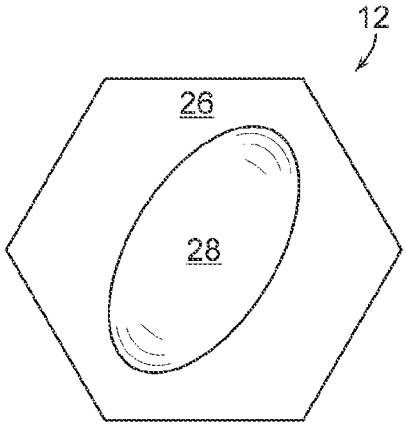
Figure 21:
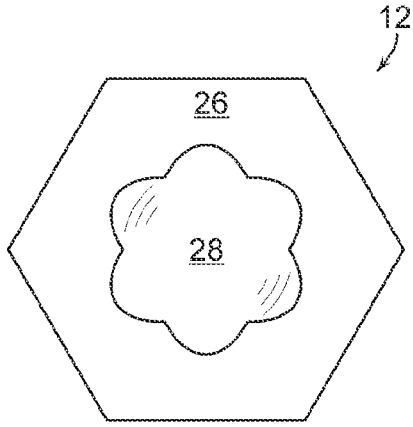

As illustrated in FIG. 17, dimple 12 may also comprise a polygonal perimeter 34 with circular depression 42 and either a subdepression 43 located within circular depression 42 or a projection 43 located within circular depression 42. A cross-sectional view of FIG. 17 can be similar to the profile shown in either FIG. 14 or FIG. 16. As in the above-discussed embodiments, the bottom of circular depression 42 may be convex, having a curvature substantially identical to the curvature of the land area and therefore having a constant depth relative to the land area, and circular depression 42 may contain a subdepression having a flat, angled or curved bottom having a varied depth relative to the land area. Alternatively, circular depression 42 may have a flat, angled or curved bottom such that its depth varies along its surface relative to the land area, and circular depression 42 may have projection 43 having a surface that curves substantially identically to the curve of the land area so that its depth is constant relative to the land area.

The dimple of the present invention may have a perimeter having any polygonal shape, e.g., pentagons, hexagons, octagons, etc. The perimeter may also comprise a partially circular shape having a number of linear sides and at least one curved side. Further, the depression may take any shape, including but not limited to regular polygons, irregular polygons, ellipses, circles, and regular lobed shapes (also called "daisies"). FIGS. 18 through 25 show variations of the inventive dimple having polygonal or partially circular perimeters and shaped depressions. In accordance with this invention, dimple 12 of FIGS. 18 through 24 and dimple 15 of FIG. 25 comprise bottom surface 28 having a depth that is substantially constant relative to the curvature of land surface 26. Preferably, the bottom 28 accounts for at least 50 percent of the surface area of the dimple. More preferably, the bottom 28 accounts for at least 67 percent of the surface area of the dimple. Most preferably, the bottom 28 accounts for at least 80 percent of the surface area of the dimple.

Figure 25:
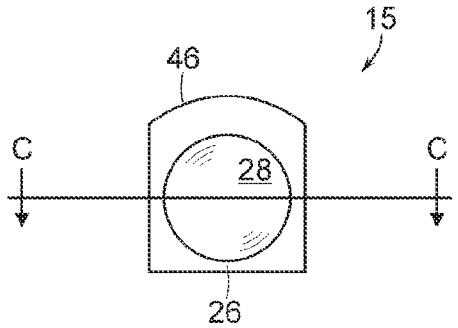

The dimple pattern of the present invention may comprise a plurality of polygonal dimples or spherical polygonal dimples as described above, a combination of polygonal dimples or spherical polygonal dimples and conventional circular dimples, or a combination of polygonal dimples or spherical polygonal dimples and partially circular dimples, an example of which is shown in FIG. 25. Partially circular dimple 15 may comprise a partially circular perimeter 46, a land surface 26 and a bottom 28 within a depression. The depression illustrated in FIG. 25 is spherical, however the depression may take any shape discussed above, including a regular polygon, irregular polygon, ellipse, etc. A cross section C-C of partially circular dimple 15 may be similar to the one shown in FIG. 6. Bottom 28 has a constant depth relative to land surface 26. In accordance with this invention, bottom 28 accounts for at least 50 percent of the surface area of dimple 15. More preferably, bottom 28 accounts for at least 67 percent of the surface area of dimple 15, and most preferably, bottom 28 accounts for at least 80 percent of the surface area of dimple 15.

Figure 26:
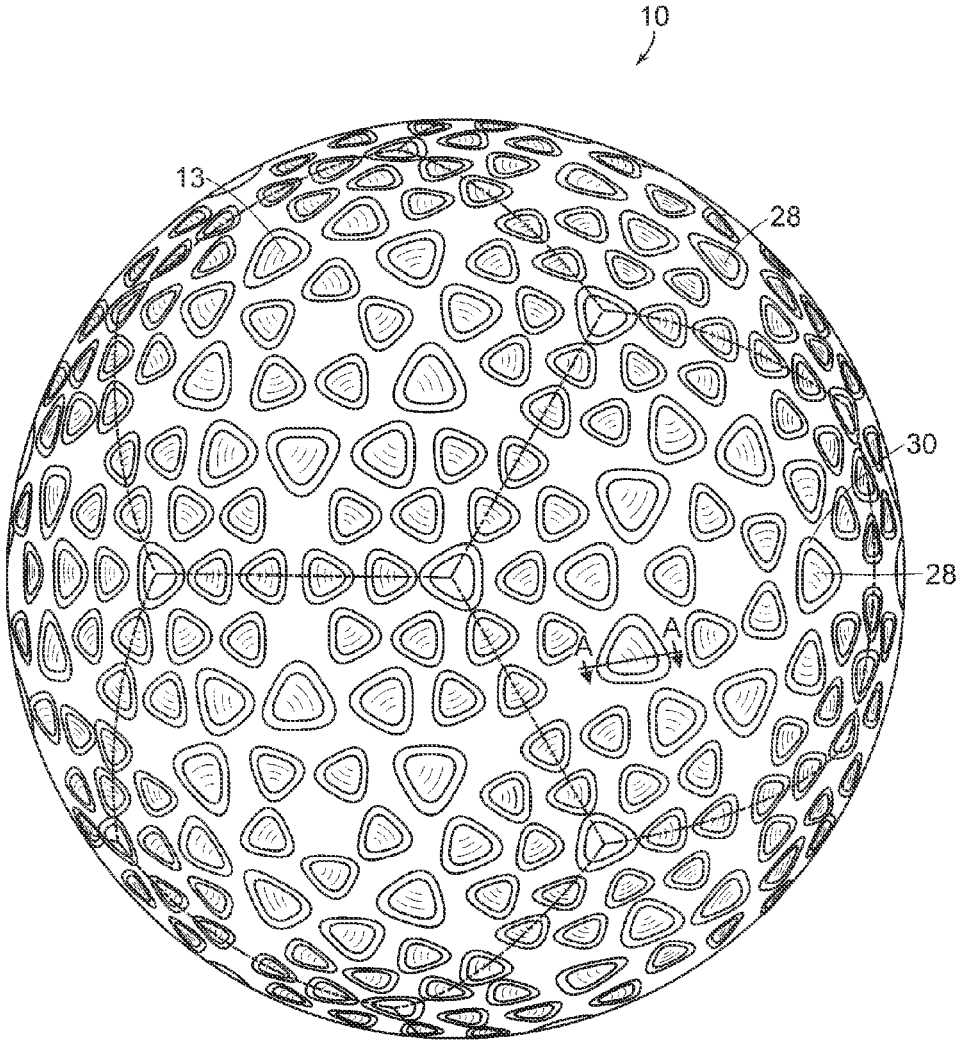
FIG. 26 shows a golf ball having a dimple pattern comprising a plurality of isodiametrical dimples having constant depth over a portion thereof.

According to another aspect of the present invention and shown in FIG. 26, golf ball 10 may have isodiametrical dimples 13. In this embodiment, dimples 13 comprise a perimeter having an odd number of sides with arcuate vertices. The sides of the isodiametrical perimeter are equal in length and the distance from the center of dimple 13 to each vertex is constant, giving the dimple a regular shape. Similar to the other embodiments shown above, and illustrated in FIG. 26, isodiametrical dimples 13 also have a substantially constant depth bottom 28 and transition area 30. FIG. 26 shows golf ball 10 having triangular isodiametrical dimples 13. Dimples 13 are not limited to the triangular isodiametrical shape and may comprise five-sided, seven-sided, nine-sided, eleven-sided or thirteen-sided shapes. Cross section A-A of dimple 13 may appear similar to the cross section shown in FIG. 6, wherein dimple 13 comprises a transition area 30, bottom 28, and land 26. Transition area 30 is preferably located at a substantially 90 degree angle to bottom 28 such that bottom 28 has a surface area about identical to the area defined by the perimeter of dimple 13. More preferably, transition area 30 is situated at a 60 to 80 degree angle with respect to bottom 28. Additionally, the bottom 28 is curved in a substantially identical manner to the curvature of land 26 and therefore has a constant depth h along its surface in relation to land 26.

Figure 27:
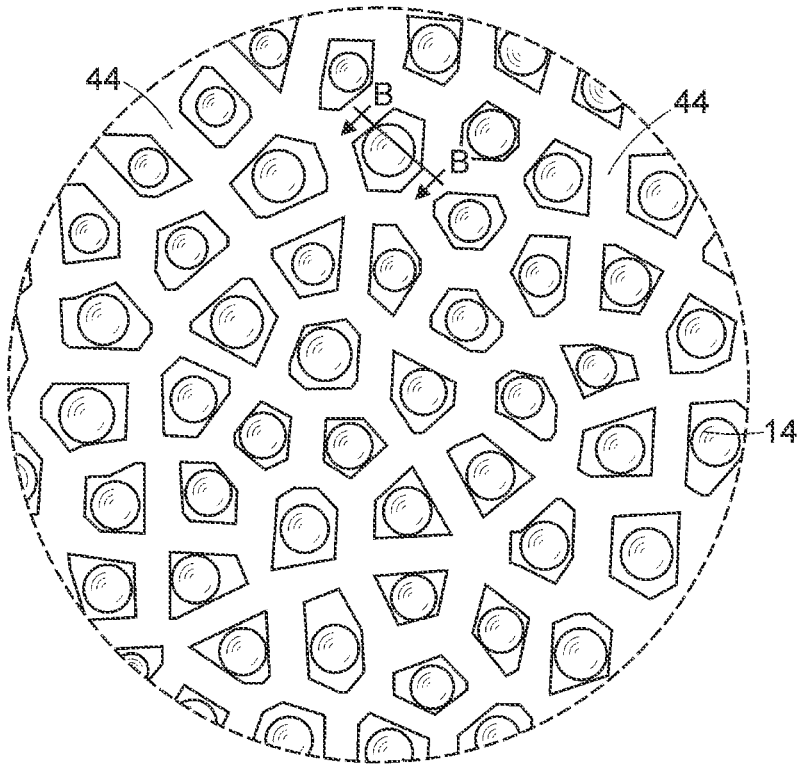
FIG. 27 shows a portion of the surface of a golf ball having a dimple pattern according to an aspect of the present invention.

The dimples of golf ball 10 could alternately be of random and irregular polygonal shapes, shown in FIG. 27. Dimples 14 are preferably separated by lands 44 that are about constant in width in relation to each other so that each dimple 14 is regularly spaced on the surface of the golf ball. As in the above-embodiment, cross section B-B of dimple 14 may be similar to the cross section shown in FIG. 6. Both dimple 13 of FIG. 26 and dimple 14 of FIG. 27 have a bottom surface 28 having a constant depth relative to the land surface that accounts for at least 50 percent of the surface area of the dimple. More preferably, the bottom surface having a constant depth accounts for at least 67 percent of the surface area of the dimple, and most preferably, the bottom surface having a constant depth accounts for at least 80 percent of the surface area of the dimple.

In accordance with another aspect of the present invention, land areas having a first width and separating distinct sections of dimples or land areas having a second width and separating dimples within a section may intersect circular dimples, causing them to appear as hemispheres or truncated circular dimples. A dimple pattern according to this design is taught in commonly owned U.S. Pat. No. 6,695,720, which is incorporated by reference herein in its entirety. In this embodiment a land area having a first width separates two identifiable sections of dimples, acting as an equator on the surface of a golf ball. The land area separating distinct sections of dimples is lined on each side by truncated circular dimples. A land area having a second width and separating dimples within an identifiable section may also intersect circular dimples.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf ball, comprising:

a substantially spherical outer surface, an undimpled land surface and a plurality of dimples formed thereon, said dimples comprising a perimeter and a depression formed therein, wherein said depression comprises a bottom and sidewalls forming a transition surface, and wherein at least a portion of said bottom is convex such that it has a curvature substantially similar to a curvature of the undimpled land surface and such that the depth of said convex portion of said bottom along its surface is substantially constant in relation to the undimpled land surface, and wherein said convex portion of said bottom comprises at least 50 percent of the surface area of said dimple, the perimeter of the dimples having a regular polygonal shape and the perimeter of the depressions having a polygonal shape.

2. The golf ball of claim 1, wherein said convex portion of said bottom comprises at least 67 percent of the surface area of said dimple.

3. The golf ball of claim 1, wherein said convex portion of said bottom comprises at least 80 percent of the surface area of said dimple.

4. The golf ball of claim 1, wherein the depression further comprises a sub-depression.

5. The golf ball of claim 4, wherein said sub-depression comprises a surface that is convex such that it has a curvature substantially similar to a curvature of the land surface and such that the depth of said sub-depression along its surface is substantially constant in relation to the land surface.

6. The golf ball of claim 4, wherein the portion of the bottom of said depression not including said sub-depression is convex such that it has a curvature substantially similar to a curvature of the land surface and such that the depth of said portion of said bottom along its surface is substantially constant in relation to the land surface.

7. The golf ball of claim 1, wherein said depression further comprises a projection located on said bottom, wherein the surface of said projection is convex such that it has a curvature substantially similar to a curvature of the land surface and such that the depth of said projection along its surface is substantially constant in relation to the land surface.

8. The golf ball of claim 1, wherein said transition surface is situated at an angle about 90 degrees with respect to said bottom.

9. The golf ball of claim 1, wherein said transition surface is situated at an angle from about 60 degrees to about 80 degrees with respect to said bottom.

10. A golf ball, comprising:

a substantially spherical outer surface, an undimpled land surface and a plurality of dimples formed thereon, said dimples comprising a perimeter and a depression fanned therein, wherein said depression comprises a bottom and sidewalls forming a transition surface, and wherein at least a portion of said bottom is convex such that it has a curvature substantially similar to a curvature of the undimpled land surface and such that the depth of said convex portion of said bottom along its surface is substantially constant in relation to the undimpled land surface, and wherein said convex portion of said bottom comprises at least 50 percent of the surface area of said dimple, the perimeter of the dimples having an isodiametrical shape, said sides being equal in length, connected by arcuate vertices, wherein said vertices are located at distances from the center of the shape that are constant with respect to each other.

11. The golf ball of claim 10, wherein the isodiametrical-shaped perimeter of the dimples has an odd number of sides.

* * * * *